US010436144B2

(12) United States Patent
Kamio et al.

(10) Patent No.: US 10,436,144 B2
(45) Date of Patent: Oct. 8, 2019

(54) INTERNAL COMBUSTION ENGINE CONTROL DEVICE AND CONTROL METHOD

(71) Applicant: NISSAN MOTOR CO., LTD., Kanagawa (JP)

(72) Inventors: Rina Kamio, Kanagawa (JP); Tomoyoshi Date, Kanagawa (JP); Daisuke Tanaka, Kanagawa (JP); Futoshi Yoshimura, Kanagawa (JP); Ryo Uchida, Kanagawa (JP)

(73) Assignee: Nissan Motor Co., Ltd., Kanagawa (JP)

( * ) Notice: Subject to any disclaimer, the term of this patent is extended or adjusted under 35 U.S.C. 154(b) by 308 days.

(21) Appl. No.: 15/531,221

(22) PCT Filed: Nov. 27, 2014

(86) PCT No.: PCT/JP2014/081350
§ 371 (c)(1),
(2) Date: May 26, 2017

(87) PCT Pub. No.: WO2016/084188
PCT Pub. Date: Jun. 2, 2016

(65) Prior Publication Data
US 2017/0328296 A1 Nov. 16, 2017

(51) Int. Cl.
*F02D 41/30* (2006.01)
*F02D 41/04* (2006.01)
(Continued)

(52) U.S. Cl.
CPC ..... *F02D 41/3094* (2013.01); *F02D 41/047* (2013.01); *F02D 41/126* (2013.01);
(Continued)

(58) Field of Classification Search
CPC .. F02D 41/3094; F02D 41/047; F02D 41/126; F02D 2250/38; F02D 2200/021; F02D 35/025; F02D 41/123
See application file for complete search history.

(56) References Cited

U.S. PATENT DOCUMENTS

2013/0297188 A1* 11/2013 Watanabe ..... F02D 41/047 701/104
2014/0182557 A1 7/2014 Arihara

FOREIGN PATENT DOCUMENTS

JP 2007-064131 A 3/2007
JP 2007-247440 A 9/2007
(Continued)

*Primary Examiner* — Xiao En Mo
(74) *Attorney, Agent, or Firm* — Osha Liang LLP

(57) ABSTRACT

A control device for an internal combustion engine including an in-cylinder injection fuel injection valve, and a port injection fuel injection valve, has a controller that controls injection amount ratios of the in-cylinder injection fuel injection valve and the port injection fuel injection valve in accordance with a driving condition of the engine. A fuel cut is performed at a predetermined deceleration of the internal combustion engine. The injection amount ratio of the in-cylinder injection fuel injection valve is corrected to be decreased at a fuel cut recovery at which a fuel supply is restarted from the fuel cut state, during a predetermined period from the start of the recovery.

6 Claims, 5 Drawing Sheets

(51) Int. Cl.
*F02D 41/12* (2006.01)
*F02D 35/02* (2006.01)

(52) U.S. Cl.
CPC ..... *F02D 35/025* (2013.01); *F02D 2200/021* (2013.01); *F02D 2250/38* (2013.01)

(56) References Cited

FOREIGN PATENT DOCUMENTS

| | | | |
|---|---|---|---|
| JP | 2009197705 | A | 9/2009 |
| JP | 2009-257192 | A | 11/2009 |

* cited by examiner

INTERNAL COMBUSTION ENGINE CONTROL DEVICE AND CONTROL METHOD

BACKGROUND

Technical Field

This invention relates to a control device and a control method for an internal combustion engine including an in-cylinder fuel injection valve which serves as a fuel supply device, and which is arranged to inject a fuel to a combustion chamber, and a port injection fuel injection valve which serves as the fuel supply device, and which is arranged to inject the fuel to an intake port, and more specifically to a control at a recovery after a fuel cut.

Related Art

A patent document 1 discloses an internal combustion engine including an in-cylinder injection fuel injection valve arranged to inject a fuel to a combustion chamber, and a port injection fuel injection valve arranged to inject the fuel to an intake port. In the patent document 1, fuel injection amount ratios of the in-cylinder fuel injection valve and the port injection fuel injection valve are successively calculated by using a map in which an engine speed, an intake air amount, and a coolant temperature are used as parameters. Even at a fuel cut recovery after the fuel cut, the fuel supply is restarted by the injection amount ratio according to the engine speed, the intake air amount and so on at that time.

Accordingly, for example, in a case where the fuel supply is arranged to be performed mainly by the in-cylinder injection on the low load side, the fuel cut recovery is started at the relatively high in-cylinder injection amount ratio.

Patent Document 1: Japanese Patent Application Publication No. 2007-64131

SUMMARY

However, in a conventional device, if the combustion is not performed within the cylinder during the fuel cut, the combustion chamber wall temperature is gradually decreased. When the fuel is injected from the in-cylinder injection fuel injection valve in the state where the combustion chamber wall temperature is decreased in this way, the fuel amount adhered on the wall surface is increased. With this, the discharge amount of particulate matter (PM) in the exhaust air which is a problem in recent years are increased. Besides, in the recent years, the discharge amount of the exhaust particulate matter tends to be restricted by particle number (PN), instead of by total weight of the particle matters.

In one or more embodiments of the present invention, a control device or control method for an internal combustion engine which includes an in-cylinder injection fuel injection valve arranged to inject a fuel into a combustion chamber, and a port injection fuel injection valve arranged to inject the fuel into an intake port, in which injection amount ratios of the in-cylinder injection fuel injection valve and the port injection fuel injection valve are controlled in accordance with a driving condition of the engine, and in which a fuel cut is performed at a predetermined deceleration of the internal combustion engine, the control device or the control method comprises: the injection amount ratio of the in-cylinder injection fuel injection valve being corrected to be decreased at a fuel cut recovery at which a fuel supply is restarted from the fuel cut state, during a predetermined period from the start of the recovery.

In a state where the combustion chamber wall temperature is decreased due to the fuel cut, the generation of the particulate matter is decreased in the intake port injection, relative to in the in-cylinder injection. Accordingly, the injection amount ratio of the in-cylinder injection is decreased during the predetermined period from the start of the recovery. With this, the discharge amount of the particulate matter is decreased.

The combustion chamber wall temperature is gradually decreased in accordance with the continuation of the fuel cut. According to one or more embodiments of the present invention, the predetermined period is set to the longer period as the fuel cut time period from the start of the fuel cut to the start of the recovery is longer. Alternatively, the predetermined period is set to the longer period as the estimated or sensed combustion chamber wall temperature at the start of the recovery is lower.

DETAILED DESCRIPTION

Hereinafter, embodiments the present invention is explained with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
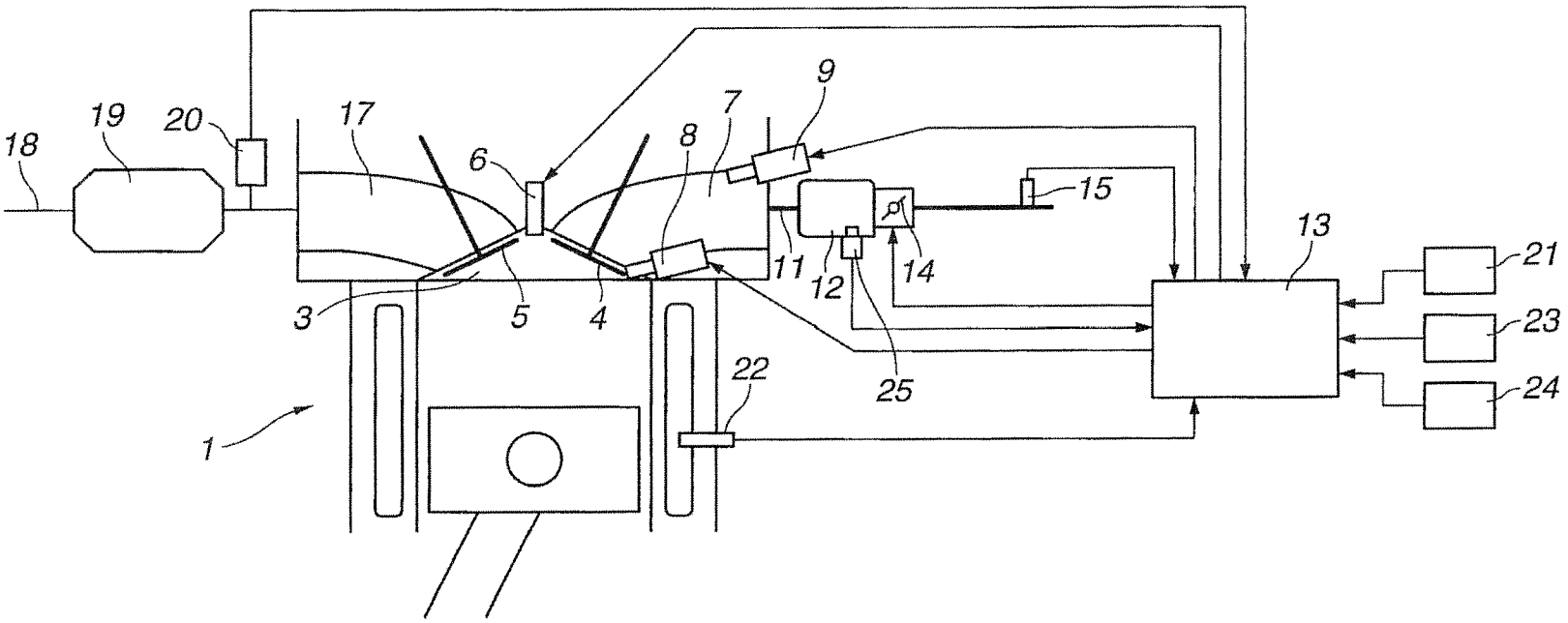
FIG. 1 is a configuration explanation view showing a system configuration of a control device according to one or more embodiments of the present invention.

FIG. 1 is a system configuration view showing an internal combustion engine 1 for a vehicle to which one or more embodiments of the present invention is applied. This internal combustion engine 1 is, for example, a four stroke cycle spark ignition internal combustion engine. A pair of intake valves 4 and a pair of exhaust valves 5 are disposed on a ceiling wall surface of a combustion chamber 3. An ignition plug 6 is disposed at a central portion surrounded by these intake valves 4 and exhaust valves 5.

An in-cylinder injection fuel injection valve 8 is disposed at a lower portion of an intake port 7 arranged to be opened and closed by one of the intake valves 4. The in-cylinder injection fuel injection valve 8 is a main fuel injection valve arranged to inject the fuel directly into the combustion chamber 3. Moreover, port injection fuel injection valves 9 are disposed, respectively, to the intake ports 7 of each of the cylinders. Each of the port injection fuel injection valves 9 is an auxiliary fuel injection valve arranged to inject the fuel into one of the intake ports 7. Each of the in-cylinder injection fuel injection valves 8 and the port injection fuel injection valves 9 is an electromagnetic injection valve or a piezoelectric injection valve arranged to be opened by being applied with a driving pulse signal, and to inject the fuel of the amount which is substantially proportional to a pulse width of the driving pulse signal.

An electrically controlled throttle valve 14 is disposed on an upstream side of a collector portion 12 in an intake passage 11 connected to the intake port 7. An opening degree of the electrically controlled throttle valve 14 is controlled by a control signal from the engine controller 13. An air flow meter 15 is disposed on an upstream side of the electrically controlled throttle valve 14. The air flow meter 15 is arranged to sense an intake air amount.

Moreover, a catalyst device 19 constituted by a three-way catalyst is disposed on an exhaust passage 18 connected to the exhaust port 17. An air-fuel ratio sensor 20 is disposed on an upstream side of the catalyst device 19. The air-fuel ratio sensor 20 is arranged to sense an air fuel ratio.

The engine controller 13 receives detection signals of sensors such as the air flow meter 15, the air-fuel ratio sensor 20, a crank angle sensor 21 arranged to sense an engine speed, a water temperature sensor 22 arranged to sense a coolant temperature, an accelerator opening degree sensor 23 arranged to sense a depression amount of an accelerator pedal operated by a driver, a vehicle speed sensor 24 arranged to sense a vehicle speed, and an intake air temperature sensor 25 arranged to sense an intake air temperature of the intake passage 11, for example, the collector portion 12. The engine controller 13 is configured to appropriately control the fuel injection amounts and the injection timings of the fuel injection valves 8 and 9, the ignition timing by the ignition plug 6, the opening degree of the throttle valve 14, and so on, based on the above-described detection signals.

Figure 2:
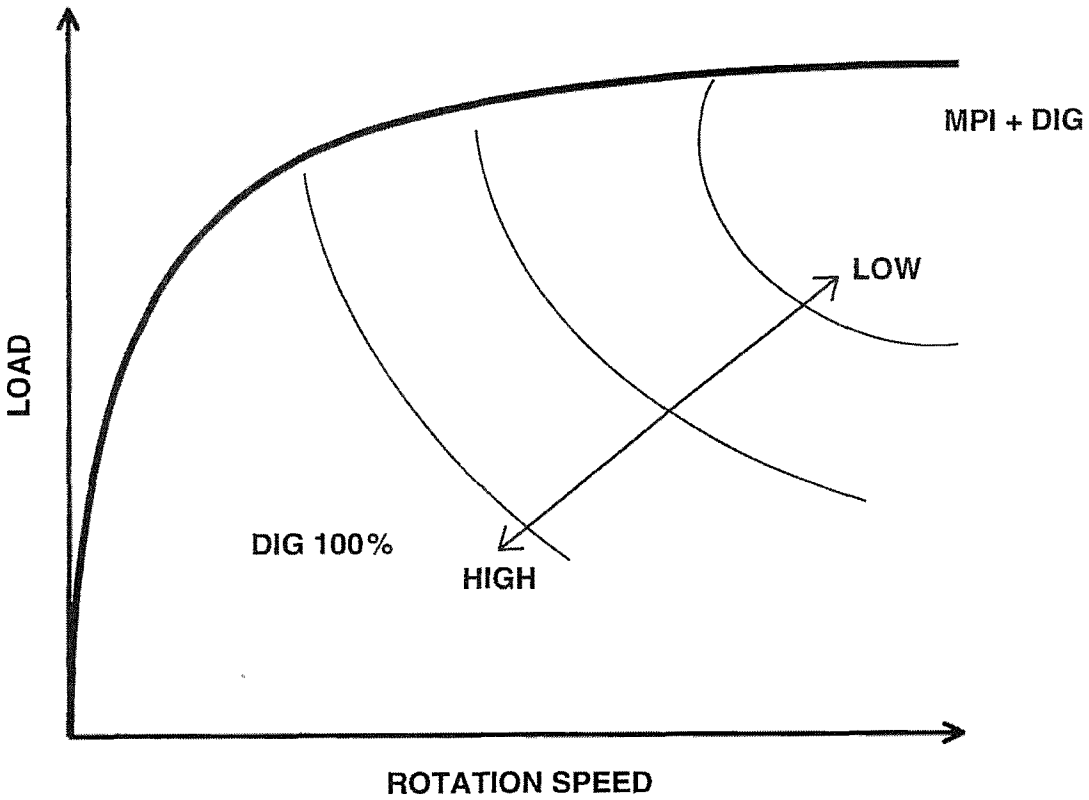
FIG. 2 is a characteristic view showing characteristics of an injection amount ratio of an in-cylinder injection in total injection.

The engine controller 13 controls the injection amount ratios of the in-cylinder injection by the in-cylinder injection fuel injection valve 8 and the port injection by the port injection fuel injection valve 9, in accordance with driving conditions of the internal combustion engine 1. FIG. 2 shows characteristics of the ratio of the injection amount of the in-cylinder injection in (to) the total injection amount (that is, a summation of the in-cylinder injection amount and the port injection amount), in the driving region of the internal combustion engine 1, by using the load and the rotation speed of the internal combustion engine 1 as the parameters. Besides, in FIG. 2 and so on, "DIG" represents the in-cylinder injection by the in-cylinder injection fuel injection valve 8. "MPI" represents the port injection by the port injection fuel injection valve 9.

As shown in FIG. 2, in one or more embodiments, the injection amount ratio of the in-cylinder injection is 100% in a region on a low speed and a low load side (that is, the all amount of the required fuel amount is injected from the in-cylinder injection fuel injection valve 8). In a region on a high speed and a high load side, the in-cylinder injection and the port injection are used together at predetermined ratios. For example, the injection amount ratio of the in-cylinder injection is about 70%. The injection amount ratio of the in-cylinder injection tends to be decreased as the load is higher, and as the engine speed is higher.

The engine controller 13 determines the necessary injection amount of the in-cylinder injection fuel injection valve 8 and the necessary injection amount of the port injection fuel injection valve 9, in accordance with the characteristics of FIG. 2. Besides, FIG. 2 shows the characteristics after the completion of the warming-up of the internal combustion engine 1. In a cold state of the engine, the characteristics of the injection amount ratios of the in-cylinder injection and the port injection is corrected based on the engine temperature, for example, the coolant temperature. Alternatively, there may be provided a plurality of the control maps corresponding to appropriate characteristics at each coolant temperature.

In one or more embodiments of the present invention, in the control of the above-described injection amount ratios, the injection amount ratios at the fuel cut recovery after the fuel cut is corrected during the predetermined period. That is, the combustion is not performed within the cylinder during the fuel cut. The intake air flows within the cylinder. Accordingly, the combustion chamber wall temperature (see, the temperatures of the cylinder wall surface and the piston crown surface) is relatively suddenly decreased. Accordingly, the fuel injected by the in-cylinder injection into the cylinder is easy to be adhered on the wall surface. This causes the increase of the discharge amount of the particulate matter. In one or more embodiments of the invention, the injection amount ratio of the in-cylinder injection at the recovery is corrected to be decreased so as to suppress this discharge of the particulate matter.

Figure 3:
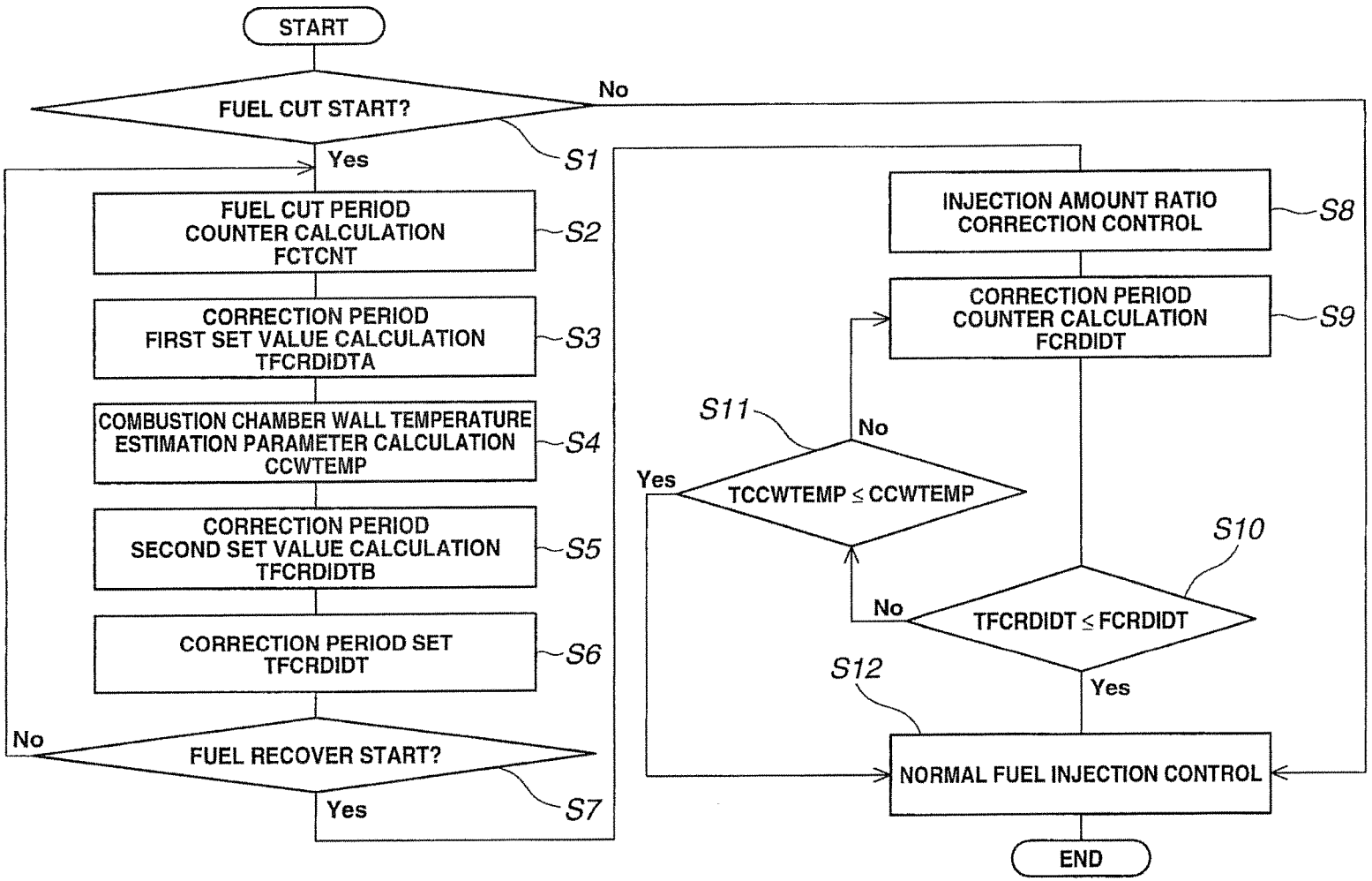
FIG. 3 is a flow chart showing a flow of a control according to one or more embodiments of the present invention.

FIG. 3 is a flow chart showing a flow of the control of one or more embodiments which is performed by the engine controller 13.

At step 1, it is judged whether or not the fuel cut is already started, that is, whether or not the engine is during the fuel cut. When the driver fully closes the accelerator pedal at the travel of the vehicle, the fuel cut is performed in a case where predetermined fuel cut conditions (for example, the coolant temperature is a temperature after the warming-up, the vehicle speed is equal to or greater than a threshold value, the engine speed is equal to or greater than a predetermined threshold value, and so on) are satisfied.

When the answer of step 1 is NO, the process proceeds to step 12. The normal fuel injection control is performed. That is, the injection amount of the in-cylinder fuel injection valve 8 and the injection amount of the port injection fuel injection valve 9 are controlled in accordance with the characteristics of the injection amount ratios shown in FIG. 2.

Figure 4:
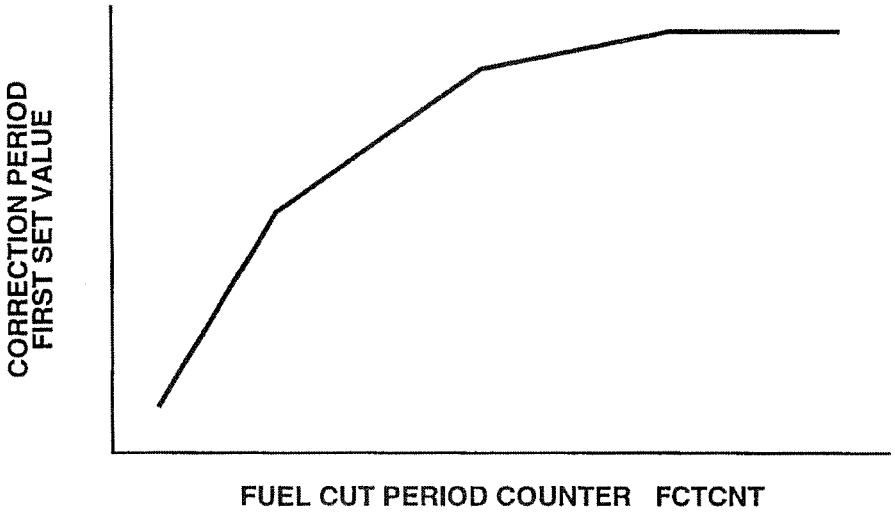
FIG. 4 is a characteristic view showing characteristics of an in-cylinder injection decrease correction period with respect to a fuel cut period.

When the engine is during the fuel cut, the process proceeds to step 2. The fuel cut time period is measured by using the counter FCTCNT indicative of the fuel cut time period. At step 3, a first set value TFCRDIDTA of the in-cylinder injection decrease correction period is determined from the characteristics table shown in FIG. 4, based on the counter FCTCNT of step 2. In this case, the first set value TFCRDIDTA becomes greater as the fuel cut time period is longer.

Moreover, the process proceeds to step S4. The combustion chamber wall temperature CCWTEMP is estimated (presumed). For example, the combustion chamber wall temperature CCWTEMP during the driving of the engine can be estimated by using parameters such as the load and the rotation speed of the internal combustion engine 1. Moreover, the combustion chamber wall temperature CCWTEMP during the driving of the engine can be estimated by using parameters such as the coolant temperature and the intake air temperature, if necessary. Furthermore, the combustion chamber wall temperature CCWTEMP during the fuel cut can be estimated by successively subtracting the temperature decrease amount from the estimated temperature at the start of the fuel cut by using the intake air temperature, the intake air amount which flows through the combustion chamber during the fuel cut, and so on. A method of the estimation of the combustion chamber wall temperature CCWTEMP is not limited to the above-described example. The method is arbitrary. Moreover, the combustion chamber wall temperature may be directly sensed.

Figure 5:
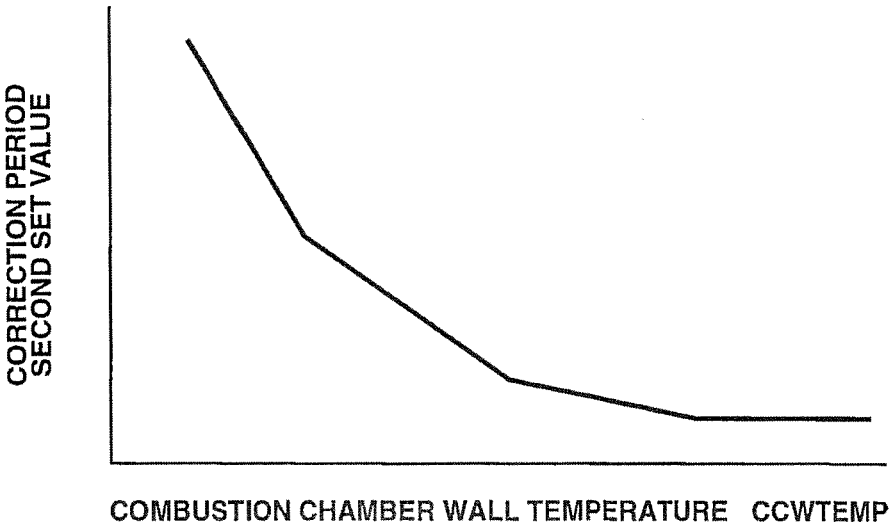
FIG. 5 is a characteristic view showing characteristics of the in-cylinder injection decrease correction period with respect to a combustion chamber wall temperature.

At step 5, a second set value TFCRDIDTB of the in-cylinder injection decrease correction period is determined from the characteristics table shown in FIG. 5, based on the combustion chamber wall temperature CCWTEMP estimated at step 4. The second set value TFCRDIDTB becomes greater as the combustion chamber wall temperature CCWTEMP is lower.

Next, at step 6, the first set value TFCRDIDTA of step 3 and the second set value TFCRDIDTB of step 5 are compared with each other. Larger one of the first set value TFCRDIDTA and the second set value TFCRDIDTB is determined as the set value TFCRDIDT of the in-cylinder injection decrease correction period.

The operations of step 2 to step 6 are repeated during the fuel cut. With this, the set value TFCRDIDT of the in-cylinder injection decrease correction period according to the fuel cut time period until that time, and the combustion chamber wall temperature CCWTEMP at that time are successively calculated.

At step 7, it is judged whether or not the fuel cut recovery is started. That is, it is judged whether or not predetermined fuel cut recovery conditions are satisfied. For example, the fuel cut recovery conditions are a condition that the vehicle speed becomes equal to or lower than a predetermined threshold value, or a condition that the engine speed becomes equal to or lower than a predetermined threshold value, in addition to the depression of the accelerator pedal by the driver.

When the fuel cut recovery is started, the process proceeds from the step 7 to the step 8. The ratio of the injection amount of the in-cylinder injection in the total injection amount is corrected to be decreased. The fuel supply is performed. That is, the basic injection amount ratios are determined as shown in FIG. 2 based on the load (the intake air amount) and the engine speed at that time. The respective injection amounts are determined that the injection amount ratios become values by which the injection amount ratio of the in-cylinder injection is lower than the basic injection amount ratio. For example, the corrected injection amount ratio is determined by subtracting the predetermined amount from the basic injection amount ratio of the in-cylinder injection, or by multiplying the basic injection amount ratio by a predetermined correction coefficient. In this case, the correction amount (for example, the subtraction amount or the correction coefficient) may be constant value. Alternatively, the correction amount may be varied in accordance with the parameters such as the fuel cut time period.

At step 9, the in-cylinder injection decrease correction period is measured by using the counter FCRDIDT indicative of the time period elapsed from the start of the recovery. At step 10, the value of this counter FCRDIDT and the set value TFCRDIDT of the in-cylinder injection decrease correction period which is set at step 6 are compared. When the value of the counter FCRDIDT becomes equal to or greater than the set value TFCRDIDT, the process proceeds to step 12. The operation is returned to the normal fuel injection control. The process is returned to the step 8 until the value of the counter FCRDIDT reaches the set value TFCRDIDT. The decrease correction of the injection amount ratio of the in-cylinder injection is continued.

Moreover, at step 11, it is judged whether or not the combustion chamber wall temperature CCWTEMP (which is continuously estimated at step 4 after the recovery) is equal to or greater than a predetermined temperature TCCWTEMP. The combustion chamber wall temperature CCWTEMP is increased by the restart of the fuel supply. When the combustion chamber wall temperature CCWTEMP becomes equal to or greater than a predetermined temperature TCCWTEMP before the value of the counter FCRDIDT reaches the set value TFCRDIDT, the decrease correction of the injection amount ratio of the in-cylinder injection is finished. The operation is returned to the normal fuel injection control of step 12. The predetermined temperature TCCTEMP is about 140 degrees. Besides, the above-described set value TFCRDIDT of the in-cylinder injection decrease correction period is set to a timing at which the actual combustion chamber wall temperature is returned to about the 140 degrees.

Figure 6:
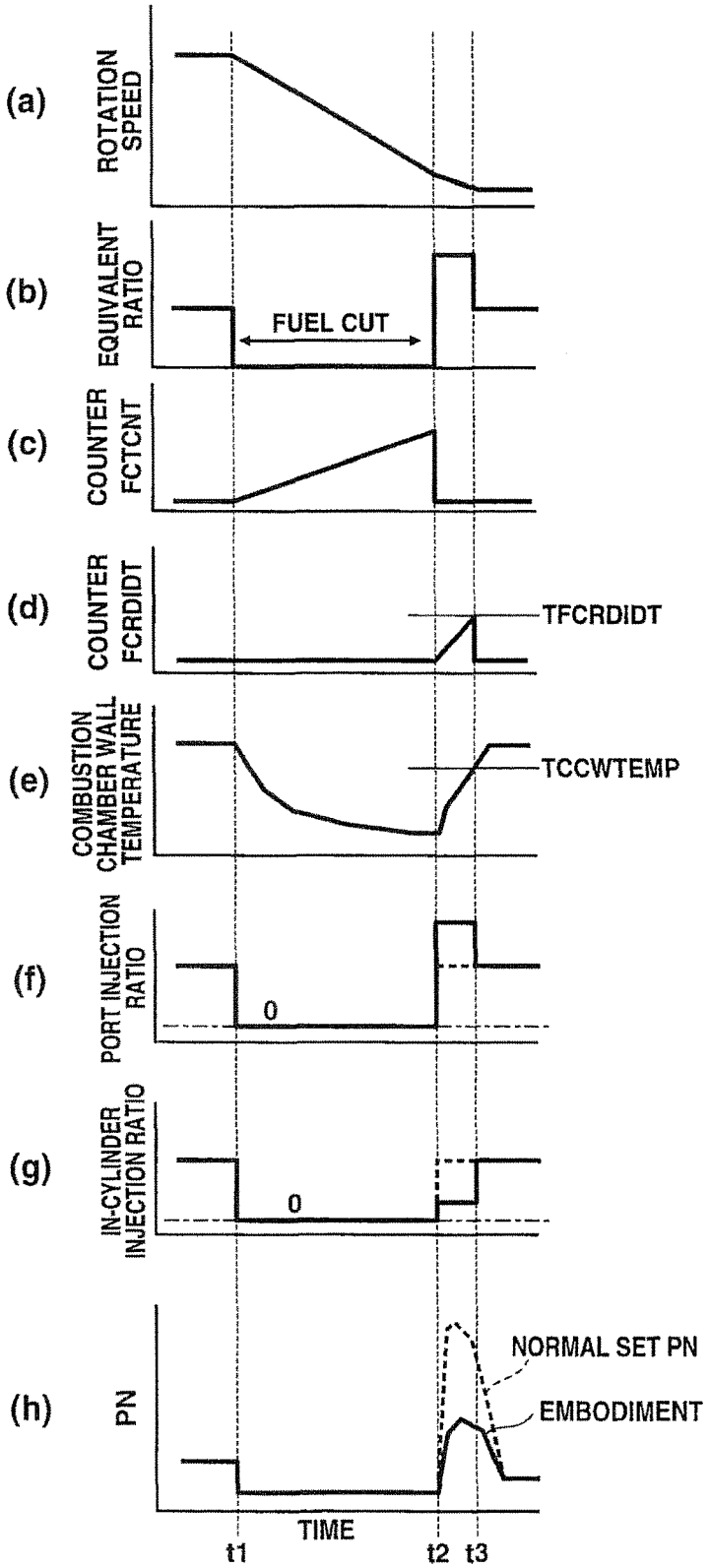
FIGS. 6(*a*)-6(*h*) are time charts showing variations of various parameters at the fuel cut and the recovery.

FIGS. 6(*a*)-6(*h*) are time charts for explaining the operations by the control of one or more embodiments of the present invention. FIGS. 6(*a*)-6(*h*) show variations of the various parameters from the start of the fuel cut to the fuel cut recovery. FIG. 6(*a*) shows the engine speed. FIG. 6(*b*) shows the equivalent ratio within the cylinder. FIG. 6(*c*) shows the counter FCTCNT indicative of the fuel cut period. FIG. 6(*d*) shows the counter FCRDIDT indicative of the in-cylinder injection decrease correction period. FIG. 6(*e*) shows the combustion chamber wall temperature CCWTEMP. FIG. 6(*f*) shows the injection amount ratio of the port injection. FIG. 6(*g*) shows the injection amount ratio of the in-cylinder injection. FIG. 6(*h*) shows the number of the particulates (PN: Particle Number) in the exhaust air.

In this example of the drawing, the in-cylinder injection and the port injection are performed until time t1 by the predetermined ratios in accordance with the characteristics of FIG. 2. At time t1, the driver fully closes the accelerator pedal opening degree, so that the fuel cut is performed. With this, the engine speed is gradually decreased. At the same time, the combustion chamber temperature is gradually decreased. The continuation time period of the fuel cut is measured by the counter FCTCNT.

Then, at time t2, the fuel cut recovery is performed based on the recovery condition such as the decrease to the threshold value of the vehicle speed. The set value TFCRDIDT of the in-cylinder injection decrease correction period is determined based on the combustion chamber wall temperature CCWTEMP and the fuel cut time period (the counter FCTCNT) at this recovery. Then, the injection amount ratio of the in-cylinder injection is set to the low value during the in-cylinder injection decrease correction period from the start of the recovery, as shown in FIGS. 6(*f*) and 6(*g*). Moreover, the injection amount ratio of the port injection is set to the high value. Besides, broken lines show basic characteristics in the normal state as shown in FIG. 2.

At time t3, the in-cylinder injection decrease correction period (the counter FCRDIDT) reaches the set value TFCRDIDT. The correction of the injection amount ratio is finished. After this time, the injection amount ratios are controlled to the normal injection amount ratios.

Besides, in the example of the drawing, the rich spike is given at the fuel cut recovery for rapidly recovering the catalysis device 19 from the excess oxygen state. The equivalent ratio temporarily becomes the rich state. This rich spike is not necessarily continued until the time t3.

In this way, the injection amount ratio of the in-cylinder injection is corrected to be decreased during the time period from t2 to t3 after the fuel cut recovery. With this, the discharge amount of the particulate matter at the recovery is suppressed. A broken line of 6(*h*) of the drawing represents the characteristics of the particle number PN when the recovery is performed without correcting the injection amount ratio. A solid line represents the characteristics of the particle number PN when the correction of the injection amount ratio is performed as in one or more embodiments of the present invention. As shown in the drawing, the particle number PN is increased at the fuel cut recovery due to the decrease of the combustion chamber wall temperature. However, in one or more embodiments of the present invention, the injection amount ratio of the in-cylinder injection is corrected to be decreased. With this, the increase of the particle number is suppressed.

Besides, the combustion chamber wall temperature CCWTEMP in FIG. 6(*e*) is increased after the start of the recovery as shown in the drawing. At time t3 at which the value of the counter FCRDIDT reaches the set value TFCRDIDT, the combustion chamber wall temperature CCWTEMP reaches a sufficient temperature at which the much particular matter are not generated even by the in-cylinder injection. In FIG. 6, the combustion chamber wall temperature CCWTEMP simultaneously reaches the predetermined temperature TCCWTEMP at time t3, for facilitating the understanding. However, as described above, the correction of the injection amount ratio is finished when the combustion chamber wall temperature CCWTEMP becomes equal to or greater than the predetermined temperature TCCWTEMP before the value of the counter FCRDIDT reaches the set value TFCRDIDT.

Hereinabove, embodiments of the present invention are explained in detail. However, the present invention is not limited to the above-described embodiments. Various modifications can be employed. For example, in the example of FIG. 3, the in-cylinder injection decrease correction period is set by using the fuel cut time period and the combustion chamber wall temperature. However, the in-cylinder injection decrease correction period may be set by only one of the fuel cut time period and the combustion chamber wall temperature.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A control device for an internal combustion engine including an in-cylinder injection fuel injection valve arranged to inject a fuel into a combustion chamber, and a port injection fuel injection valve arranged to inject the fuel into an intake port, comprising:

a controller that controls injection amount ratios of the in-cylinder injection fuel injection valve and the port injection fuel injection valve in accordance with a driving condition of the engine, wherein a fuel cut is performed at a predetermined deceleration of the internal combustion engine, wherein the injection amount ratio of the in-cylinder injection fuel injection valve is corrected to be decreased at a fuel cut recovery at which a fuel supply is restarted from the fuel cut state, during a predetermined period from the start of the recovery, and wherein the predetermined period is set to a longer period as the fuel cut time period from a start of the fuel cut to the start of the recovery is longer.

2. A control device for an internal combustion engine including an in-cylinder injection fuel injection valve arranged to inject a fuel into a combustion chamber, and a port injection fuel injection valve arranged to inject the fuel into an intake port, comprising:

a controller that controls injection amount ratios of the in-cylinder injection fuel injection valve and the port injection fuel injection valve in accordance with a driving condition of the engine, wherein a fuel cut is performed at a predetermined deceleration of the internal combustion engine, wherein the injection amount ratio of the in-cylinder injection fuel injection valve is corrected to be decreased at a fuel cut recovery at which a fuel supply is restarted from the fuel cut state, during a predetermined period from the start of the recovery, and wherein a combustion chamber wall temperature at the start of the recovery is estimated or sensed; and the predetermined period is set to a longer period as the combustion chamber wall temperature at the start of the recovery is lower.

3. A control device for an internal combustion engine including an in-cylinder injection fuel injection valve arranged to inject a fuel into a combustion chamber, and a port injection fuel injection valve arranged to inject the fuel into an intake port, comprising:

a controller that controls injection amount ratios of the in-cylinder injection fuel injection valve and the port injection fuel injection valve in accordance with a driving condition of the engine, wherein a fuel cut is performed at a predetermined deceleration of the internal combustion engine, wherein the injection amount ratio of the in-cylinder injection fuel injection valve is corrected to be decreased at a fuel cut recovery at which a fuel supply is restarted from the fuel cut state, during a predetermined period from the start of the recovery, wherein a combustion chamber wall temperature at the start of the recovery is estimated or sensed, and wherein the decrease correction of the injection amount ratio is finished when the combustion chamber wall temperature becomes equal to or greater than a predetermined temperature during the predetermined period.

4. A control method for an internal combustion engine including an in-cylinder injection fuel injection valve arranged to inject a fuel into a combustion chamber, and a port injection fuel injection valve arranged to inject the fuel into an intake port, comprising:

controlling injection amount ratios of the in-cylinder injection fuel injection valve and the port injection fuel injection valve in accordance with a driving condition of the engine;

performing a fuel cut at a predetermined deceleration of the internal combustion engine;

correcting to decrease the injection amount ratio of the in-cylinder injection fuel injection valve at a fuel cut recovery at which a fuel supply is restarted from the fuel cut state, during a predetermined period from the start of the recovery;

estimating or sensing a combustion chamber wall temperature at the start of the recovery; and setting the predetermined period to a longer period as the combustion chamber wall temperature at the start of the recovery is lower.

5. A control method for an internal combustion engine including an in-cylinder injection fuel injection valve arranged to inject a fuel into a combustion chamber, and a port injection fuel injection valve arranged to inject the fuel into an intake port, comprising:

controlling injection amount ratios of the in-cylinder injection fuel injection valve and the port injection fuel injection valve in accordance with a driving condition of the engine;

performing a fuel cut at a predetermined deceleration of the internal combustion engine;

correcting to decrease the injection amount ratio of the in-cylinder injection fuel injection valve at a fuel cut recovery at which a fuel supply is restarted from the fuel cut state, during a predetermined period from the start of the recovery;

estimating or sensing a combustion chamber wall temperature at the start of the recovery; and setting the predetermined period to a longer period as the combustion chamber wall temperature at the start of the recovery is lower.

6. A control method for an internal combustion engine including an in-cylinder injection fuel injection valve arranged to inject a fuel into a combustion chamber, and a port injection fuel injection valve arranged to inject the fuel into an intake port, comprising:

controlling injection amount ratios of the in-cylinder injection fuel injection valve and the port injection fuel injection valve in accordance with a driving condition of the engine;

performing a fuel cut at a predetermined deceleration of the internal combustion engine; the control method comprising:

correcting to decrease the injection amount ratio of the in-cylinder injection fuel injection valve at a fuel cut recovery at which a fuel supply is restarted from the fuel cut state, during a predetermined period from the start of the recovery;

estimating or sensing a combustion chamber wall temperature at the start of the recovery; and finishing the decrease correction of the injection amount ratio when the combustion chamber wall temperature becomes equal to or greater than a predetermined temperature during the predetermined period.

* * * * *